United States Patent [19]

Hill et al.

[11] 4,218,998

[45] Aug. 26, 1980

[54] SPARK IGNITION SYSTEMS FOR INTERNAL COMBUSTION ENGINES

[75] Inventors: William F. Hill, Stafford; George Gol, Sutton Coldfield, both of England

[73] Assignee: Lucas Industries Limited, Birmingham, England

[21] Appl. No.: 922,400

[22] Filed: Jul. 6, 1978

[51] Int. Cl.³ ..... F02P 9/00; F02B 77/08

[52] U.S. Cl. ..... 123/335; 123/630; 123/198 D; 123/198 DC

[58] Field of Search ..... 123/198 D, 198 DC, 148 S, 123/118

[56] References Cited

U.S. PATENT DOCUMENTS

| | | | |
|---|---|---|---|
| 3,599,049 | 8/1971 | Barnaid | 123/198 D |
| 3,665,903 | 5/1972 | Harris et al. | 123/148 S |
| 3,760,781 | 9/1973 | Boldt | 123/198 DC |
| 3,916,848 | 11/1975 | Schmidt | 123/198 D |
| 3,960,128 | 6/1976 | Anderson et al. | 123/118 |
| 4,034,732 | 7/1977 | Van Burkleo | 123/198 DC |
| 4,054,117 | 10/1977 | Palmer et al. | 123/198 D |
| 4,078,531 | 3/1978 | Hewitt | 123/198 D |
| 4,099,495 | 7/1978 | Kienche et al. | 123/198 DC |

FOREIGN PATENT DOCUMENTS

| | | | |
|---|---|---|---|
| 2296764 | 9/1976 | France | 123/198 DC |
| 1516301 | 7/1978 | United Kingdom | 123/198 DC |

*Primary Examiner*—Ira S. Lazarus

*Attorney, Agent, or Firm*—Ladas & Parry

[57] ABSTRACT

An internal combustion engine spark ignition system is provided which ensures that sparks are inhibited if the engine temperature exceeds a maximum safe level. The ignition circuit includes an input transistor which is switched on and off by an engine shaft transducer. The input transistor controls charging and discharging of a capacitor the voltage on which determines whether switching of the input transistor causes a spark to be produced via an output amplifier and ignition coil. A temperature sensing element determines both the rate at which the capacitor can charge and the final voltage to which it can be charged.

3 Claims, 1 Drawing Figure

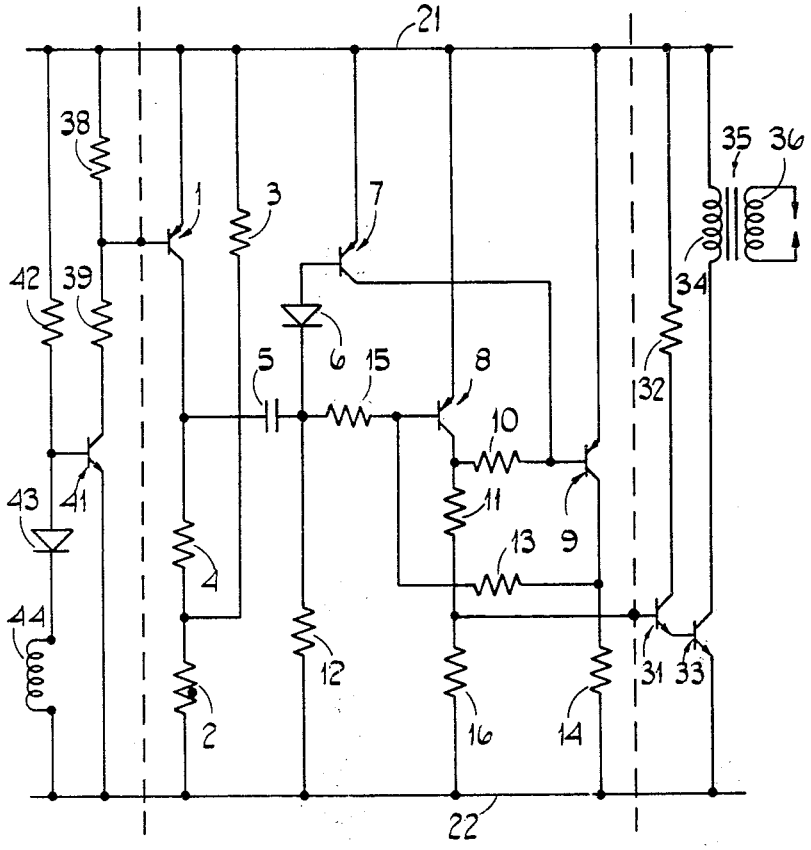
21
38
1
3
7
35
36
42
39
34
6
5
15
8
32
10
43
41
11
13
9
4
44
12
31
33
2
16
14
22

SPARK IGNITION SYSTEMS FOR INTERNAL COMBUSTION ENGINES

This invention relates to spark ignition systems for internal combustion engines.

In one aspect, the invention resides in a spark ignition system for an internal combustion engine, in which the production of sparks is inhibited if the engine temperature is above a predetermined value.

In another aspect, the invention resides in a spark ignition system for an internal combustion engine including common control means for inhibiting the production of sparks if the rotational speed of the engine is above a set value, or the engine temperature is above a predetermined value.

Preferably, the rotational engine speed at which sparks are inhibited is progressively reduced as the engine water temperature progressively increases.

The accompanying drawing is a circuit diagram illustrating one example of the invention.

Referring to the drawing, there are provided positive and negative supply lines 21, 22 which are connected to the vehicle battery through an ignition switch, the line 22 being earthed. Connected to the line 21 is the emitter of a p-n-p transistor 1 having its collector connected through a resistor 4 and a thermistor 2 in series to the line 22, the junction of the resistor 4 and thermistor 2 being connected through a resistor 3 to the line 21. The collector of the transistor 1 is connected through a capacitor 5 and a resistor 15 in series to the base of a p-n-p transistor 8 having its emitter connected to the line 21 and its collector connected through a resistor 11 to the line 22. The junction of the capacitor 5 and resistor 15 is connected to the line 22 through a resistor 12, and the collector of the transistor 8 is further connected through a resistor 10 to the base of a p-n-p transistor 9 and the collector of a p-n-p transistor 7, the emitters of the transistors 7 and 9 being connected to the line 21. The base of the transistor 7 is connected through a diode 6 to the junction of the capacitor 5 and resistor 15, and the collector of the transistor 9 is connnected through a resistor 14 to the line 22 and through a resistor 13 to the base of the transistor 8. The junction of the resistors 11, 16 is connected to the base of an n-p-n transistor 31 with its collector connected through a resistor 32 to the line 21 and emitter connected to the base of an n-p-n transistor 33. The transistor 33 has its emitter connected to the line 22 and its collector connected to the line 21 through the primary winding 34 of an ignition transformer 35, the secondary winding 36 of which is connected in the usual way to the plugs of the engine.

The base of the transistor 1 is connected through a resistor 38 to the line 21 and through a resistor 39 to the collector of an n-p-n transistor 41, the emitter of which is connected to the line 22. The base of the transistor 41 is connected to the line 21 through a resistor 42, and is also connected to the line 22 through a diode 43 and a variable reluctance pick-up 44 in series.

Any convenient form of magnetic means driven by the engine is used to produce pulses in the pick-up 44. These pulses commence at a point in time which is dependent on the rotational speed of the engine, and have a pulse width which decreases as the rotational speed of the engine increases. The pulses terminate when a spark is required. In considering the operation, it is convenient to assume that the rotatonal speed of the engine is below a set value, and that the engine temperature (detected by measuring engine water temperature) is also below a predetermined value. In these circumstances, when there is no pulse in the pick-up 44, current flows through the emitter-base paths of both transistors 7 and 8 to hold them on, and so the transistor 9 is held off. While the transistor 8 is on the transistors 31, 33 are on and energy is stored in the primary winding 34.

When there is no pulse in the pick-up 44, the transistor 41 is on, and so the transistor 1 conducts and the capacitor 5 does not charge. However, when a pulse appears in the pick-up 44, the transistor 41 is turned off, the transistor 1 turns off, and the capacitor 5 now charges through the emitter-base of the transistor 7, the diode 6, the resistor 4 and the thermistor 2. The transistor 7 and 8 remain on, and the transistor 9 remains off. At the end of the pulse at the terminal 23, the transistor 1 turns on again, and so the left-hand plate of the capacitor 5 is connected to the line 21, with the result that the right-hand plate of the capacitor 5 is raised in potential to a level in excess of the potential of the line 21. The actual level will depend on the degree to which the capacitor 5 was charged during the off period of the transistor 1, which depends both on the width of the pulse at the terminal 23, which depends on the rotational speed of the engine, and on the resistance of resistor 2. The arrangement is such that with the rotational speed of the engine below the set value referred to previously, and the engine temperature below the predetermined value referred to previously, the potential on the right-hand plate of the capacitor 5 when the transistor 1 turns on again is sufficient to turn off both transistors 7 and 8, with the result that the transistor 9 turns on. Although there is a minimum potential at the right-hand plate of the capacitor 5 which is required to turn off the transistors 7 and 8, it will be appreciated that once the transistors 7 and 8 turn off, then by virtue of the feedback by way of the resistor 13, the transistor 9 will stay on even though the minimum potential at the right-hand plate of the capacitor 5 is no longer present, and will remain on until the capacitor 5 has discharged, at which point the transistors 7 and 8 turn on again, the transistor 9 turns off and the cycle is repeated. When the transistor 8 turns off, the current flowing in the primary winding 34 coil is broken, and a spark is produced.

Consider now the situation when the rotational speed of the engine exceeds the predetermined value. In these circumstances, the width of the pulse in the pick-up 44 is reduced to a level such that when the transistor 1 turns on again, the potential at the right-hand plate of the capacitor 5 is sufficient to turn off the transistor 7, but not the transistor 8. The transistor 9 does not now turn on, and no spark is produced. The engine speed will fall, and sparks will be produced again when the pulse width increases sufficiently.

Consider now the situation in which the rotational speed of the engine is below the set value, but the engine temperature rises to an unacceptable level. In these circumstances, the resistance of thermistor 2 changes in value to an extent such that whatever the rotational speed of the engine, the capacitor 5 does not charge sufficiently to turn the transistor 8 off when the transistor 1 turns on. In these circumstances, no sparks can be produced.

It will be understood that although the extreme conditions have been described above, the value of the thermistor 2 will change constantly with engine water temperature, and so the set rotational engine speed at which sparks are inhibited will decrease as the engine water temperature increases.

In the preferred arrangement, the thermistor 2 is a barium titanate thermistor, which is suitably positioned on the engine to sense engine temperature.

It will be noted that as the temperature increases the resistance of thermistor 2 increases and this has two effects. Firstly it increases the charging time constant of the capacitor 5 because it increases the total resistance in series with the capacitor. Secondly it increases the voltage at the junction of resistor 3 and thermistor 2 so that the maximum voltage towards which capacitor 5 charges is decreased.

We claim:

1. A spark ignition system for an internal combustion engine including common control means for inhibiting the production of sparks if the rotational speed of the engine is above a set value which is decreased progressively with increasing engine temperature, or the engine temperature is above a predetermined value, irresponsive of engine speed.

2. A spark ignition system for an internal combustion engine comprising a pick-up producing a pulsed output at a frequency proportional to the engine speed, and spark control means connected to said pick-up and producing sparks in synchronism with the pulses therefrom, said spark control means including spark inhibiting means operable when the pulse frequency exceeds a set value and including a temperature sensor sensitive to the engine temperature and determining said set value so that the set value decreases with increasing engine temperature, said temperature sensing operating to inhibit sparks if the engine temperature rises above a predetermined value, irrespective of engine speed.

3. A system as claimed in claim 2 in which the pick-up produces a pulse train of substantially constant mark space ratio, and said spark control means including a capacitor charged during the mark periods and discharged during the space periods, the voltage to which said capacitor charges being dependent on the pulse frequency, said temperature sensor being a temperature sensitive resistor in the charging path of the capacitor, and means responsive to the voltage on said capacitor for inhibiting spark generation when the voltage on said capacitor is below a predetermined value.

* * * * *